US005528974A

United States Patent [19]

Yoshida et al.

[11] Patent Number: 5,528,974

[45] Date of Patent: Jun. 25, 1996

[54] SABOT SEPARATOR FOR PROJECTILE ACCELERATOR

[75] Inventors: Hiro Yoshida, Tsukuba; Kazuo Uematsu, Yokohama, both of Japan

[73] Assignees: Agency of Industrial Science & Technology; Ministry of International Trade & Industry, both of Tokyo, Japan

[21] Appl. No.: 219,307

[22] Filed: Mar. 28, 1994

[30] Foreign Application Priority Data

May 12, 1993 [JP] Japan ..... 5-110578

[51] Int. Cl.[6] ..... F41A 21/46

[52] U.S. Cl. ..... 89/14.6; 73/12.11; 89/8

[58] Field of Search ..... 73/12.01, 12.09, 73/12.11; 89/8, 14.6

[56] References Cited

U.S. PATENT DOCUMENTS

| | | | |
|---|---|---|---|
| H357 | 11/1987 | Howland et al. | 89/8 |
| 3,224,337 | 12/1965 | Ford et al. | 89/14.6 |
| 3,857,050 | 12/1974 | Harris et al. | 89/8 |
| 4,433,570 | 2/1984 | Brown et al. | 73/12.11 |
| 4,938,113 | 7/1990 | Kemeny et al. | 89/8 |
| 5,081,901 | 1/1992 | Kemeny et al. | 89/8 |

*Primary Examiner*—Stephen C. Bentley

*Attorney, Agent, or Firm*—Oblon, Spivak, McClelland, Maier & Neustadt

[57] ABSTRACT

A sabot separator includes a sabot separation cylinder equipped with a pair of rail electrodes extending axially and connected with a muzzle end of a barrel of a projectile accelerator. An electrical power source is connected between the rail electrodes and applies a voltage to the rail electrodes for producing a force in a direction for decelerating the accelerating sabot. When the sabot enters the sabot separation cylinder, an electric current flows through the sabot and the sabot is suddenly stopped by a braking force resulting from the flow of the electric current.

2 Claims, 3 Drawing Sheets

SABOT SEPARATOR FOR PROJECTILE ACCELERATOR

BACKGROUND OF THE INVENTION

1. Field of the Invention

This invention relates to a sabot separator for a projectile accelerator for launching single, small particles.

2. Description of the Prior Art

The strength of a material against impact can be tested by conducting an impact resistance test in which an object (projectile) is projected onto the material at high velocity.

Acceleration of the particle has conventionally been achieved using a powder gun, gas gun, electrothermal or electromagnetic gun. A method of accelerating a small particle using a powder gun or a gas gun should be avoided, however, because these guns produce contaminating exhaust gases. As a practical matter, therefore, the choice is limited to an electrothermal or electromagnetic accelerator.

As shown in FIG. 4, the electrothermal accelerator has a barrel 1 made of an electrical insulating material, an electrode 2 disposed at the breech of the barrel, an electrode 3 disposed at an intermediate portion thereof, and a circuit 6, which consists of a switch 4 and a high-voltage, large-capacity power supply unit 5, connected between the electrodes 2, 3. An annular evaporation member 7 made of a metal foil with a low vaporization temperature is inserted into the barrel 1 and a projectile 8 is inserted into an intermediate part of the barrel 1. When the switch 4 is closed, the heat generated by the electrical discharge occurring between the electrodes 2, 3 at the breech of the barrel vaporizes the evaporation member 7 and the pressure of the gas generated accelerates the projectile 8 and launches it from the muzzle of the barrel 1.

As shown in FIG. 5(*a*) and 5(*b*), the electromagnetic accelerator has a pair of parallel rail electrodes 9, 10 and a pair of insulators 11 that close the spaces between the rails so as to form a barrel 1. A circuit 6 consisting of a switch 4 and a high-voltage, large-capacity power supply unit 5 is connected between the breech ends of the rail electrodes 9, 10, and a projectile 8 is loaded in barrel 1. When the switch 4 is closed, current i flows through an electrically conductive armature 12 attached to the rear of the projectile 8. The current i produces a magnetic field perpendicular to the drawing sheet. The Lorentz force simultaneously produced in the armature 12 accelerates the projectile 8 and launches it from the muzzle of the barrel 1.

In either of the aforesaid accelerators, there is a limit to how small the bore of the barrel 1 can be fabricated. When the projectile 8 to be launched is very small, therefore, it is loaded on a sabot 13 fabricated in a size that is easy to handle (see FIG. 6) and the sabot 13 and the projectile 8 are accelerated together. The muzzle of the barrel 1 is formed with sabot separator 15 with a converging region 14. The sabot 13 is decelerated and stopped by the sabot separator 15, while the projectile 8 separates from the sabot 13 owing to its inertia. Thus only the projectile 8 is launched.

In the prior art sabot separators just described, the high compressive force acting on the sabot 13 when it is decelerated and stopped by impact with the steel sabot separator 15 shatters the peripheral region of the sabot 13 tip. If the velocity of the projectile 8 is high, the sabot 13 may completely disintegrate. In either case, this leads to the problem that fragments 13' fly out of the barrel 1 together with the projectile 8.

This invention was accomplished in the light of the aforesaid problem and has as its object to provide a sabot separator for a projectile accelerator which prevents damage to the sabot and enables complete separation of the sabot and the projectile.

SUMMARY OF THE INVENTION

For achieving this object, a first aspect of the invention provides a sabot separator for installation at the muzzle end of a barrel of a projectile accelerator, which sabot separator comprises an annular sabot stopper formed at its center with a projectile launching aperture, the sabot stopper being installed at the muzzle end of the barrel, and an annular sabot damage prevention member made of a material of low impact impedance and attached to a stopper surface of the sabot stopper lying perpendicular to the barrel.

In a preferred aspect, the invention provides a sabot separator comprising a sabot separation cylinder equipped with a pair of rail electrodes extending axially and connected with the muzzle end of the barrel and an electrical power source connected between the rail electrodes for producing a force in the direction for decelerating the accelerated sabot.

In the sabot separator according to the first aspect of the invention, the sabot stopper provided at the muzzle end of the barrel of the projectile accelerator has an inner sabot stopper surface that lies perpendicular to the barrel axis and a sabot damage prevention member made of a low impact impedance material is provided on the sabot stopper surface. When the sabot collides with the sabot damage prevention member, the damage prevention member absorbs the impact pressure of the sabot so that the sabot is decelerated and stopped while preventing or greatly reducing its compressive destruction.

In the sabot separator according to the second aspect of the invention, the rail electrodes are electrically connected by the accelerated electrically conductive sabot when it enters the sabot separation cylinder. The current flowing through the sabot at this time produces a magnetic field perpendicular to the drawing sheet, whereby a Lorentz force is simultaneously produced in the direction opposite to that in which the sabot was accelerated. The sabot is thus decelerated and stopped by the Lorentz force. Since the sabot can therefore be stopped without impact, compressive destruction of the sabot is prevented or greatly reduced.

As a result, complete separation of the sabot and the projectile can be achieved according to either aspect of the invention.

The above and other features of the invention will become apparent from the following description made with reference to the drawings.

BRIEF DESCRIPTION OF THE DRAWINGS

FIG. 2(*b*) is a sectional view taken along line II—II of FIG. 2(*a*).

FIG. 5(*b*) is a sectional view taken along line V—V in FIG. 5(*a*).

DESCRIPTION OF THE PREFERRED EMBODIMENTS

Figure 1:
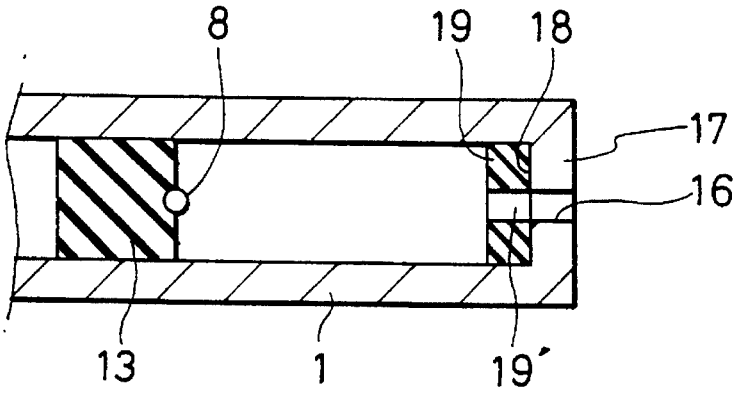
FIG. 1 is a schematic side sectional view of a first embodiment of the sabot separator according to the invention.

FIG. 1 shows a first embodiment of the sabot separator for a projectile accelerator according to the invention. In this figure, reference numeral 1 designates a barrel, 8 a small projectile and 13 a sabot for carrying the projectile 8 so as to be separable therefrom.

In view of the small size of the projectile, the projectile accelerator employed should not project fragments or other contaminating materials together with the projectile and should not disrupt the test environment with exhaust gas. The well-known electrothermal and electromagnetic accelerators both meet these requirements.

The small projectile 8 contemplated by this invention is a sphere measuring 0.51–1 mm in diameter. It is made of a material selected from among steel, ceramic, alumina, magnetic samarium, cobalt or the like, in accordance with the type of specimen to be subjected to the impact resistance test. The sabot 13 used as a carrier for the projectile 8 is a cylindrical body of a diameter matched to the bore of the barrel 1. It can be made of polychloro-trifluoro-ethylene, polycarbonate or the like.

The muzzle of the barrel 1 of the projectile accelerator is fitted with a sabot separator comprising an annular sabot stopper 17 having an aperture projectile launching aperture 16 of a diameter capable of passing the projectile 8.

The inner side of the sabot stopper 17 is formed with a flat sabot stopper surface 18 lying perpendicular to the axis of the barrel 1 and an annular sabot damage prevention member 19 made of a material exhibiting low impact impedance and formed at its center with a projectile passage 19' is attached to the sabot stopper surface 18. Impact impedance is defined as the physical quantity obtained by multiplying the density of a material by its sound velocity. Specific examples of materials with low impact impedance include rubber, teflon, nylon, urethane, resin, wood and the like.

The operation of the aforesaid sabot separator will now be explained.

Figure 4:
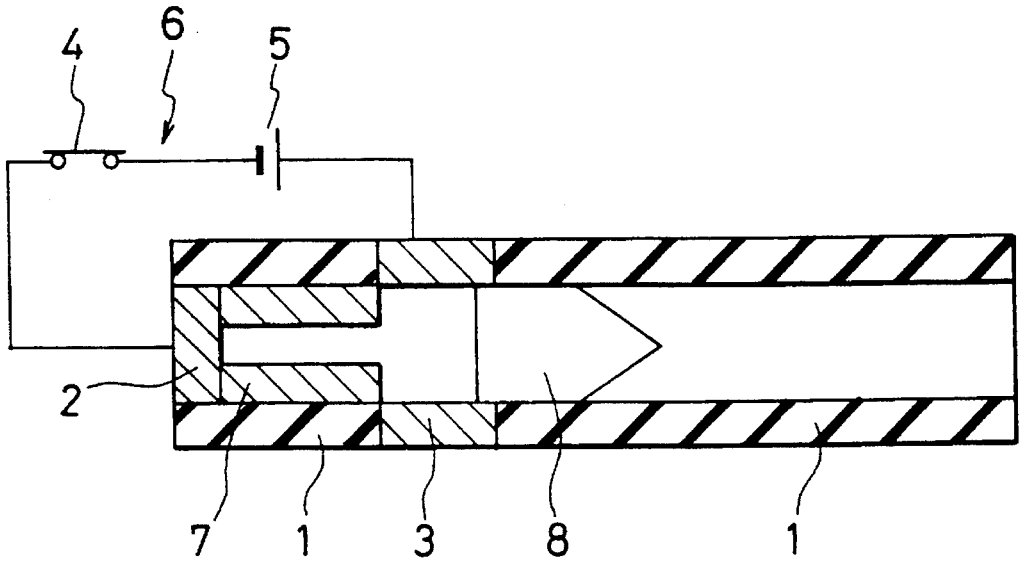
FIG. 4 PRIOR ART
FIG. 4 is a schematic side sectional view of a prior art electrothermal projectile accelerator.
Figure 5A:
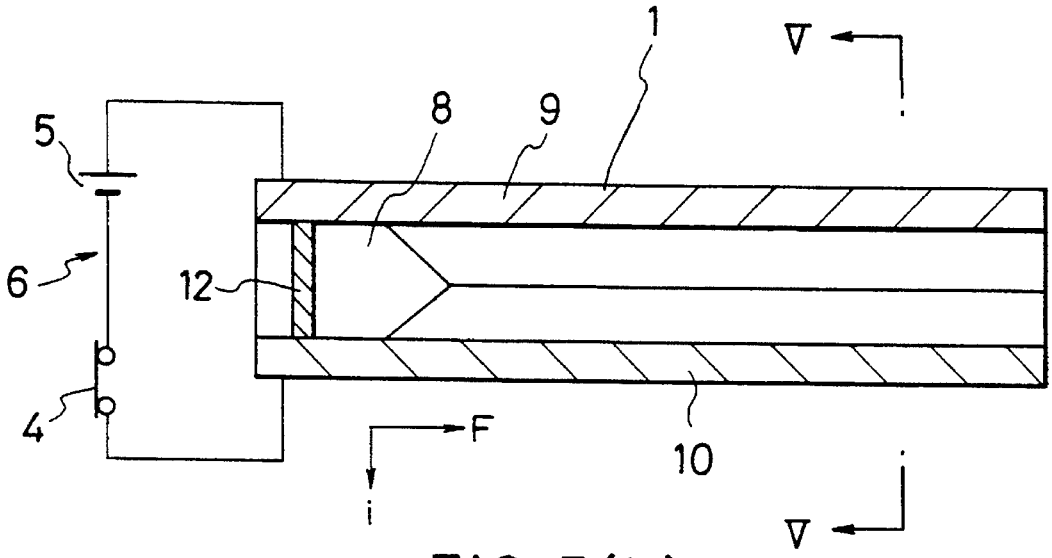
FIG.5(a) PRIOR ART
FIG. 5(*a*) is a schematic side sectional view of a prior art electromagnetic projectile accelerator.
Figure 5B:
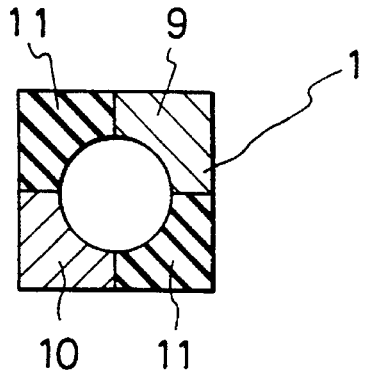
FIG.5(b) PRIOR ART
Figure 6:
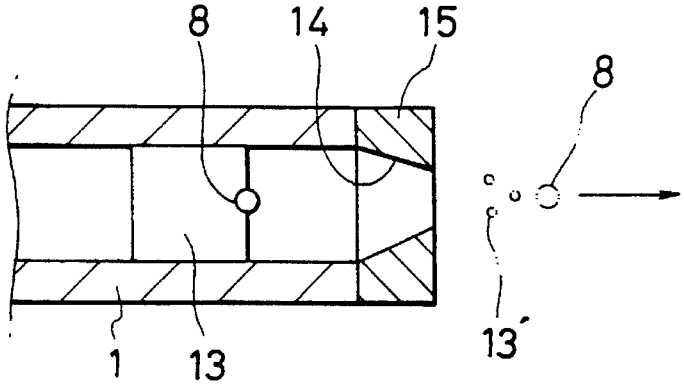
FIG.6 PRIOR ART
FIG. 6 is a schematic side view of a prior art sabot separator.

First, the projectile 8 is attached to the sabot 13 with grease or the like and the sabot 13 with the projectile 8 attached thereto is loaded in the barrel 1 of a known electrothermal or electromagnetic accelerator. The projectile accelerator is then operated for accelerating the sabot 13 and the projectile 8 through the barrel 1 to a velocity of around 1000 m/s. The process by which the sabot 13 and the projectile 8 are accelerated is the same as that explained earlier with reference to FIGS. 4 and 5 and will not be discussed further here.

The leading end of the sabot 13 accelerated through the barrel 1 collides with the sabot stopper surface 18 through the sabot damage prevention member 19. Since the sabot stopper surface 18 lies perpendicular to the travel direction of the sabot 13, the entire forward end surface of the sabot 13 collides therewith. As the sabot damage prevention member 19 made of a material with a low impact impedance is located between the sabot 13 and the sabot stopper surface 18, however, the impact pressure produced by the collision is reduced to about 1/30 in the case of rubber what it would otherwise be. Thus while the sabot 13 experiences momentary compression, it does not disintegrate. On the other hand, the inertia of the projectile 8 causes it to pass through the projectile passage 19' and the projectile launching aperture 16 and fly to the exterior at a prescribed velocity.

This aspect of the invention thus makes it possible to completely separate the sabot 13 and the projectile 8.

Figure 2A:
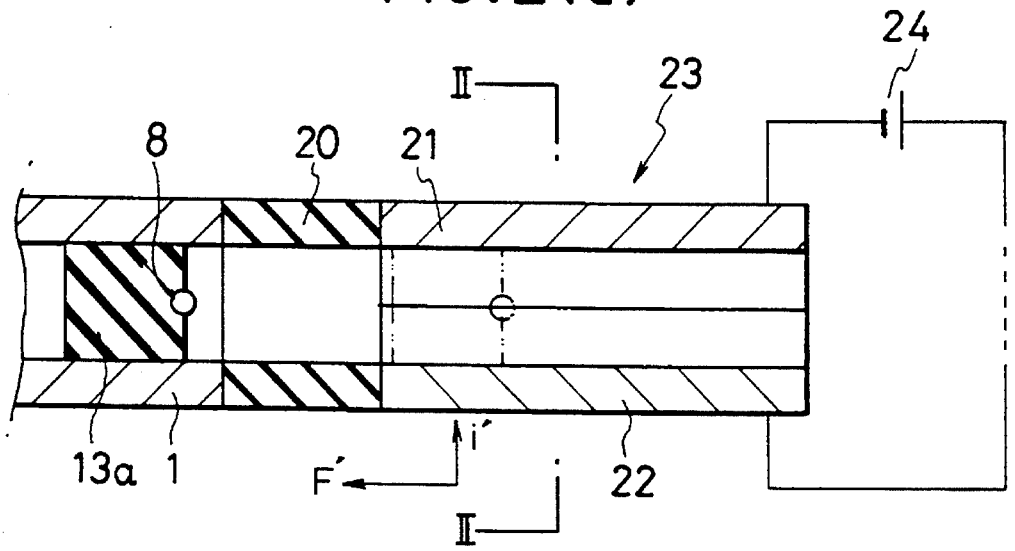
FIG. 2(*a*) is a schematic side sectional view of a second embodiment of the sabot separator according to the invention.
Figure 2B:
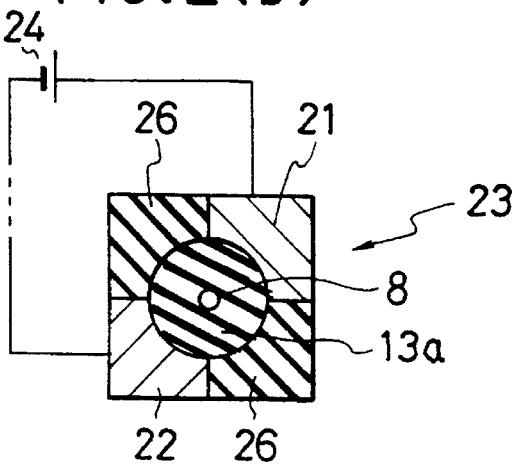

FIGS. 2(*a*) and 2(*b*) show a second embodiment of the sabot separator according to the invention. In this aspect of the invention, a sabot separator 23 is connected to the muzzle end of the barrel 1 of a projectile accelerator through an insulation cylinder 20. The sabot separator 23 consists of a pair of rail electrodes 21, 22 extending the axial direction of the barrel 1 and a pair of insulators 26, 26 that close the spaces between the rails. A deceleration power source 24 for producing a force in the direction causing the sabot 13*a* to decelerate is connected between the rail electrodes 21, 22. This arrangement constitutes an electromagnetic accelerator that produces a force in the direction opposite to that in which the projectile 8 is accelerated.

The sabot 13*a* for carrying the projectile 8 is made of an electrically conductive material. The projectile system constituted by the projectile 8 and the sabot 13*a* is accelerated by the projectile accelerator so that it passes along the barrel 1, through the insulation cylinder 20 and into the rail sabot separator 23. When it enters the sabot separator 23, it electrically connects the rail electrodes 21, 22. The current i' which passes through the sabot 13*a* as a result produces a magnetic field perpendicular to the drawing sheet, resulting in the simultaneous generation of a Lorentz force F' that acts on the sabot 13*a*. The Lorentz force F' serves to decelerate and stop the sabot 13*a* while allowing only the projectile 8 to fly out of the sabot separator 23 under its own inertia at its accelerated speed.

Since this embodiment of the invention enables the sabot 13*a* to be stopped without a collision, compressive destruction of the sabot 13*a* is prevented or greatly reduced. Therefore, no fragments of the sabot 13*a* are projected together with the projectile 8.

Figure 3:
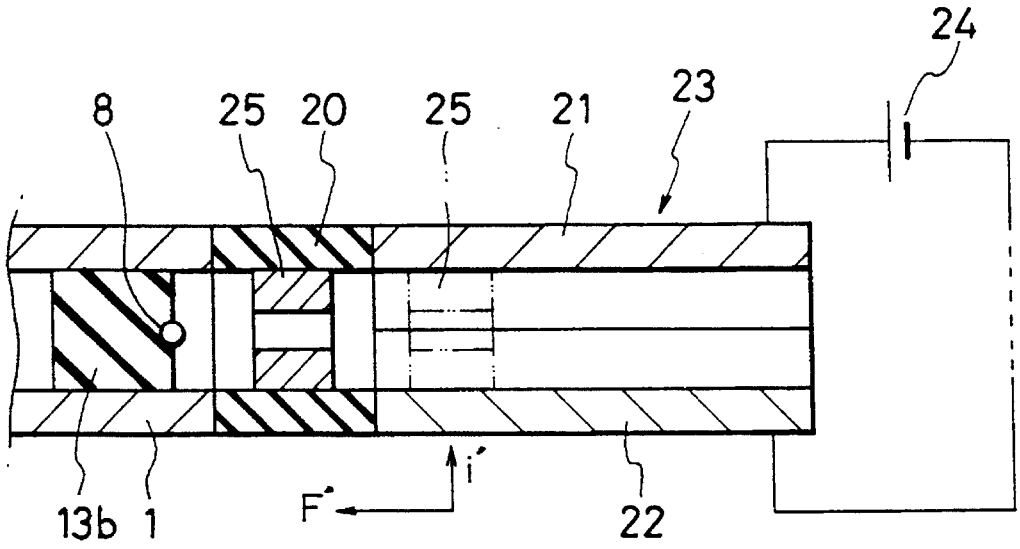
FIG. 3 is a schematic side sectional view showing a modification of the embodiment of FIG. 2(*a*).

FIG. 3 shows a modification of the embodiment of FIG. 2(*a*) in which the sabot 13*b* is made of an insulating (nonconductive) material. If a nonconductive sabot 13*b* were to be used in a projectile accelerator configured as shown in FIG. 2(*a*), no current would flow between the rail electrodes 21, 22 even with the sabot 13*b* present in the sabot separator 23. The sabot 13*b* would therefore not be decelerated or stopped because neither a magnetic field nor a Lorentz force would be produced.

In the modification shown in FIG. 3, this problem is overcome by disposing a conductive ring 25 in the insulation cylinder 20 that interconnects the barrel 1 and the sabot separator 23. When the nonconductive sabot 13*b* carrying the projectile 8 reaches the conductive ring 25, it pushes the conductive ring 25 into the sabot separator 23. As a result, current flows between the rail electrodes 21, 22 via the conductive ring 25, whereby a magnetic field and a Lorentz force are produced in a manner similar to that in the configuration of FIG. 2(*a*). Since the conductive ring 25 is therefore decelerated and stopped, the sabot 13*b* is also stopped, while only the projectile 8 is allowed to fly to the exterior. The conductive ring 25 can be made of copper or phosphor bronze.

Specific examples of the invention will now be explained.

An annealed copper cylinder measuring 15 mm in outer diameter and 145 mm in length was used as a barrel. The muzzle end of the barrel was fitted with a sabot stopper constituted of 32 mm long rubber cylinder formed at one end with a hole measuring 15 mm in internal diameter and 16 mm in depth and the other end with a projectile launching aperture measuring 1.5 mm in internal diameter. The sabot was a polychloro-trifluoro-ethylene disk measuring 4 mm in diameter and 2 mm in thickness. The projectile was a 0.95 mm steel ball was attached to the center of the sabot with grease.

The breech of the barrel was charged with a piece of aluminum foil (15 μm (t)×3 mm (w)×20 mm (conductive length)) and then with the sabot. Pulse current was supplied to the aluminum foil at a peak rate of about 15 KA and a pulse width of 50 μs. The aluminum foil was instantaneously heated, melted and vaporized. The plasma pressure produced by the vaporization of the aluminum foil propelled the sabot toward the muzzle. The vaporized aluminum solidified and adhered to the inner surface of the barrel in the form of fine particles.

As explained in the foregoing, the sabot separator for a projectile accelerator according to the invention is able to prevent damage to a sabot even when the projectile accelerator is used to launch a small particle on the 1 mm order at a velocity of about 1000 m/s. It is also able to ensure satisfactory separation of the sabot and the projectile. The invention can therefore be applied with excellent effect in such fields as space dust impact simulation, impact simulation of foreign object damage in ceramic gas turbines, new material strength testing, and machine processing techniques that rely on impact force.

Japanese Patent Application No. 5-110578 filed May 12, 1993 is hereby incorporated by reference.

What is claimed is:

1. A sabot separator for installation at a muzzle end of a barrel of a projectile accelerator, comprising:

a sabot separation cylinder equipped with a pair of rail electrodes insulated from each other, extending axially and connected with the muzzle end of the barrel;

a sabot equipped with a projectile, accelerated in the barrel and moving toward the sabot separation cylinder, said sabot being made of an electrically conductive material; and an electrical power source connected between the rail electrodes for applying, to the rail electrodes, a voltage for producing a force in a direction for decelerating and stopping the accelerating sabot in the sabot separation cylinder to launch the projectile alone from the sabot separation cylinder.

2. A sabot separator for installation at a muzzle end of a barrel of a projectile accelerator, comprising:

a sabot separation cylinder equipped with a pair of rail electrodes insulated from each other, extending axially and connected with the muzzle end of the barrel;

a sabot accelerated in the barrel and moving toward the sabot separation cylinder, said sabot being made of an insulating material;

an electrically conductive ring pushed by the sabot through the sabot separation cylinder for electrically connecting the pair of rail electrodes; and an electrical power source connected between the rail electrodes for applying, to rail electrodes, a voltage for producing a force in a direction for decelerating the accelerating sabot.

* * * * *

UNITED STATES PATENT AND TRADEMARK OFFICE

CERTIFICATE OF CORRECTION

PATENT NO. : 5,528,974
DATED : June 25, 1996
INVENTOR(S) : Hiro YOSHIDA, et al.

It is certified that error appears in the above-indentified patent and that said Letters Patent is hereby corrected as shown below:

On the title page, Item [73], the Assignee should read:

-- [73] Agency of Industrial Science & Technology,
Ministry of International Trade & Industry,
Tokyo, Japan --

Signed and Sealed this

Fifteenth Day of October, 1996

Attest:

Bruce Lehman

BRUCE LEHMAN

Attesting Officer

Commissioner of Patents and Trademarks